US008992270B2

(12) United States Patent
Glick et al.

(10) Patent No.: US 8,992,270 B2
(45) Date of Patent: Mar. 31, 2015

(54) ELECTRICAL TERMINAL

(71) Applicant: Lear Corporation, Southfield, MI (US)

(72) Inventors: Michael Glick, Farmington Hills, MI (US); Slobodan Pavlovic, Novi, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 56 days.

(21) Appl. No.: 13/904,195

(22) Filed: May 29, 2013

(65) Prior Publication Data

US 2014/0087602 A1 Mar. 27, 2014

Related U.S. Application Data

(60) Provisional application No. 61/705,830, filed on Sep. 26, 2012.

(51) Int. Cl.
*H01R 4/48* (2006.01)
*H01R 13/18* (2006.01)
*H01R 13/187* (2006.01)

(52) U.S. Cl.
CPC ..... *H01R 13/18* (2013.01); *H01R 13/187* (2013.01)
USPC ..... 439/839; 439/843

(58) Field of Classification Search
CPC .... H01R 13/18; H01R 13/111; H01R 13/187; H01R 13/20; H01R 13/15; H01R 13/112
USPC ..... 439/839, 842–857
See application file for complete search history.

(56) References Cited

U.S. PATENT DOCUMENTS

| | | | | | |
|---|---|---|---|---|---|
| 4,540,234 | A * | 9/1985 | Konnemann et al. | ..... | 439/839 |
| 5,064,379 | A | 11/1991 | Ryll et al. | | |
| 5,147,230 | A | 9/1992 | Plyler et al. | | |
| 5,664,972 | A * | 9/1997 | Zinn et al. | ..... | 439/839 |
| 5,735,716 | A * | 4/1998 | Bilezikjian | ..... | 439/843 |
| 5,868,590 | A * | 2/1999 | Dobbelaere | ..... | 439/839 |
| 5,941,740 | A * | 8/1999 | Neuer et al. | ..... | 439/852 |
| 5,975,964 | A * | 11/1999 | Seko et al. | ..... | 439/857 |
| 6,402,571 | B1 * | 6/2002 | Muller et al. | ..... | 439/745 |
| 7,252,559 | B1 * | 8/2007 | Morello et al. | ..... | 439/843 |
| 7,278,891 | B2 * | 10/2007 | Cvasa et al. | ..... | 439/852 |
| 7,556,542 | B2 * | 7/2009 | Lischeck et al. | ..... | 439/851 |
| 7,892,050 | B2 * | 2/2011 | Pavlovic et al. | ..... | 439/839 |
| 8,339,235 | B2 * | 12/2012 | Beckert et al. | ..... | 337/198 |
| 8,475,220 | B2 * | 7/2013 | Glick et al. | ..... | 439/839 |
| 8,678,867 | B2 * | 3/2014 | Glick et al. | ..... | 439/843 |
| 2014/0087601 | A1 | 3/2014 | Glick et al. | | |

* cited by examiner

*Primary Examiner* — Thanh Tam Le
(74) *Attorney, Agent, or Firm* — Brooks Kushman P.C.

(57) ABSTRACT

An electrical terminal includes a contact portion having a contact portion base with at least three sides forming a generally polyhedron structure. At least one contact arm extends from at least some of the sides, and are arranged to receive a mating electrical component. A spring arrangement includes a plurality of spring arms extending from a spring base. Each of the spring arms includes a spring head in contact with at least one respective contact arm near a distal end of the contact portion for applying a force thereto in a direction toward a central axis of the terminal. The spring base includes a support structure configured to support the mating electrical component.

18 Claims, 3 Drawing Sheets

ELECTRICAL TERMINAL

CROSS-REFERENCE TO RELATED APPLICATIONS

This application claims the benefit of U.S. provisional application No. 61/705,830 filed 26 Sep. 2012, which is hereby incorporated herein by reference.

TECHNICAL FIELD

The present invention relates to an electrical terminal.

BACKGROUND

Electrical terminals are known to have various configurations. Examples of electrical terminals are described in the following patents and patent applications: U.S. Pat. No. 5,334,058, U.S. Pat. No. 6,475,040, DE10019241, U.S. Pat. No. 5,755,599, U.S. Pat. No. 5,664,972, U.S. Pat. No. 4,040,713, U.S. Pat. No. 5,064,379, U.S. Pat. No. 5,147,230, U.S. Pat. No. 5,064,379, WO8905531, and US20090085712. With the increased use of round and square pins to make electrical connections—as opposed to flat blades—a need exists for an electrical terminal that can receive such pins, and which can handle the higher current loads found in many modern applications, as well as maintain required normal force over many insertions and removals of the mating pins.

SUMMARY

At least some embodiments of the invention include an electrical terminal including a contact portion having a contact portion base with a plurality of sides and forming a polyhedron structure. The contact portion further includes a plurality of contact arms, at least one of the contact arms extending from a respective one of at least two of the sides. The contact arms being arranged to receive a mating electrical component to contact each of the contact arms at a distal portion of the mating electrical component. A spring arrangement includes a spring base and a plurality of spring arms extending therefrom. Each of the spring arms contacts at least one of the contact arms near a distal end of the contact portion for applying a force thereto in a direction toward a central axis of the contact portion. The spring base is disposed toward a proximal end of the contact portion and includes an aperture for receiving the mating electrical component therethrough. The aperture is sized such that a proximal portion of the mating electrical component is supported by the spring base.

At least some embodiments of the invention include an electrical terminal including a contact portion having a contact portion base with a plurality of sides and forming a polyhedron structure having a central axis. The contact portion further includes a plurality of contact arms, at least one of the contact arms extending from a respective one of at least two of the sides. The contact arms are arranged to receive a mating electrical component to contact each of the contact arms at a distal portion of the mating electrical component. A spring arrangement includes a spring base disposed within the contact portion and toward a proximal end thereof. The spring arrangement further includes a plurality of spring arms extending therefrom, each of the spring arms contacting at least one of the contact arms near a distal end of the contact portion for applying a force thereto in a direction toward the central axis of the contact portion. The spring base includes a support structure for supporting a proximal portion of the mating electrical component.

At least some embodiments of the invention include an electrical terminal including a contact portion having a plurality of contact arms arranged to receive a mating electrical component and support the mating electrical component at a distal portion thereof. A spring arrangement includes a spring base disposed within the contact portion and toward a proximal end thereof. The spring base includes a support structure for supporting a proximal portion of the mating electrical component.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
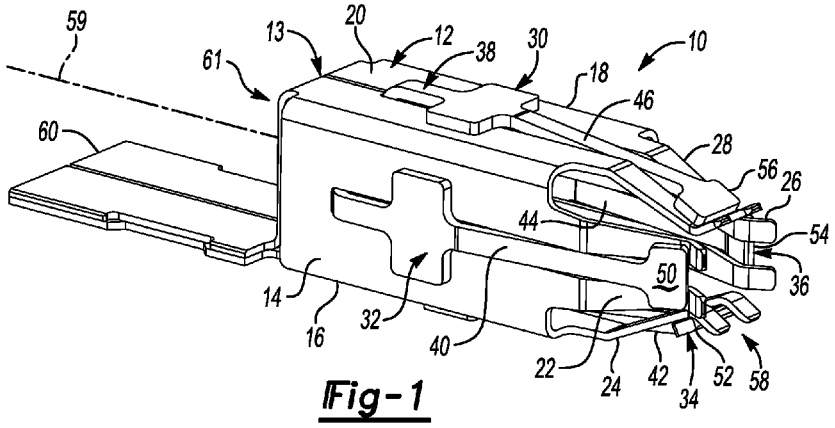
FIG. 1 shows a perspective view of an electrical terminal in accordance with an embodiment of the present invention.

FIG. 1 shows a perspective view of an electrical terminal 10 in accordance with an embodiment of the present invention. The terminal 10 includes a contact portion 12 having a contact portion base 13 and sides 14, 16, 18, 20 forming a generally rectangular structure. The contact portion 12 further includes four pairs of contact arms 22, 24, 26, 28, each extending from a respective one of the sides 14, 16, 18, 20. As described in more detail below, the contact arms 22, 24, 26, 28 are arranged to receive a mating electrical component, such as a round or square pin, such that each pair of contact arms 22, 24, 26, 28 contacts the mating electrical component.

The terminal 10 also includes a spring arrangement 30 that includes four spring arms 32, 34, 36, 38. Each of the spring arms 32, 34, 36, 38 has a respective spring body 40, 42, 44, 46 disposed along a central portion of a respective pair of the contact arms 22, 24, 26, 28. Each of the spring arms 32, 34, 36, 38 also includes a respective spring head 50, 52, 54, 56 in contact with a respective pair of the contact arms 22, 24, 26, 28 near a distal end 58 of the contact portion 12. The spring heads 50, 52, 54, 56 apply a force to the respective pair of contact arms 22, 24, 26, 28 in a direction that is toward an opposite pair of the contact arms—e.g., the spring head 56 applies a force to the contact arms 28 in a direction toward the opposite pair of contact arms 24; similarly, the contact head 34 applies a force to the contact arms 24 in a direction toward the opposite pair of contact arms 28. As explained in more detail below, the configuration of the spring arrangement, and in particular the contact of the spring heads to the respective pairs of contact arms, increases the normal force that will be applied to a mating electrical component, such as a pin.

Although the embodiment shown in FIG. 1 is a four-sided generally rectangular structure, embodiments of the present invention may include less than or more than four sides to create a different type of generally polyhedron structure. For example, a three-sided structure may have a generally triangular cross section, and a five-sided structure may have a generally pentagonal cross section. In such a case, a spring would not apply a force to a set of contact arms in a direction toward an opposite pair of contact arms since the above examples have an odd number of sides. Rather, the springs in these embodiments will apply a force on the respective contact arms in a direction toward a central axis of the contact portion 12, such as the axis 59 shown in FIG. 1. In addition to the embodiments described above, a contact portion, such as the contact portion 12, may have an odd or even number of sides, but have contact arms extending out from only some of the sides. For example, the contact portion 12 could be configured as an octagonal structure, but have contact arms extending out from only four sides.

A terminal, such as the terminal 10 may be effective for use in high current applications, where a soft copper conductor may lose its ability to apply a normal force in the presence of the potentially high heat associated with some high current applications. To help avoid this problem, some prior art electrical terminals use a copper or other metal alloy that may have better high-temperature properties; however, this is often to the detriment of the conductivity which may be better with a more pure copper or with a softer copper or other metal alloy. In the electrical terminal shown in FIG. 1, the contact portion 12 can be made from a relatively soft copper material, such as C151, or other material having good conductivity such as an aluminum alloy, while the spring arrangement 30 can be made from a relatively stiff and strong material, such as 301 stainless steel.

Although the tension applied to the contact arms 22, 24, 26, 28 by the spring heads 50, 52, 54, 56 would usually be adequate to keep the components in their relative orientations, the embodiment shown in FIG. 1 provides an additional feature to further ensure that the relative orientation is maintained. As shown in FIG. 1, each of the spring bodies 40, 42, 44, 46 has at least a portion disposed between a respective pair of the contact arms 22, 24, 26, 28, which helps to ensure that the spring heads 50, 52, 54, 56 are in the proper position and apply the force generally equally between each of the respective contact arms in the pairs of contact arms 22, 24, 26, 28. In particular, the arrangement of the contact arms 22, 24, 26, 28 and the associated spring bodies 40, 42, 44, 46 helps to ensure that relative lateral movement between them is prohibited, or at least inhibited or otherwise limited. Also shown in FIG. 1, the contact portion 12 includes a platform 60 configured to connect with a wire or other electrical component, for example, by sonic welding. The platform 60 extends from a proximal end 61 of the contact portion 12.

Figure 2:
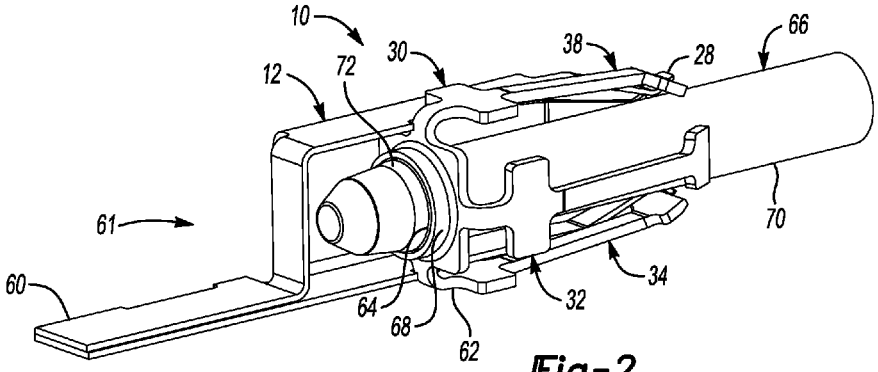
FIG. 2 shows a fragmentary view of the electrical terminal from FIG. 1 with a mating electrical component in the form of a round pin.

FIG. 2 shows a fragmentary view of the electrical terminal 10 shown in FIG. 1. In addition to the spring arms 32, 34, 36 (not visible in FIG. 2), 38, and the respective spring bodies and spring heads (not labeled in FIG. 2), the spring arrangement 30 includes a spring base 62, from which each of the spring arms 32, 34, 36, 38 extends outwardly. The spring base 62 and the spring arms 32, 34, 36, 38 are, in this embodiment, made from a single piece of material. The spring base 62 includes a support structure, which in this embodiment includes an aperture 64 disposed therethrough for receiving a mating electrical component, such as the round pin 66. The aperture 64 is sized to receive the pin 66 with a clearance fit, or even a slight interference fit. This configuration helps to support the pin 66 and allows the terminal 10 to mate with much longer pins than might otherwise be possible. That is, if the only contact between a long pin, such as the pin 66, and the electrical terminal 10 was at the contact arms 22, 24, 26, 28 (see FIG. 1), an undesirable amount of relative motion between the pin 66 and the terminal 10 could occur. Having a spring base 62 configured with the aperture 64 provides the additional support required to reduce this relative motion and thus allow the terminal 10 to interface with longer pins, such as the pin 66.

In the embodiment shown in FIG. 2, the support structure further includes a neck 68 disposed around the aperture 64, and it may be formed, for example, through a drawing process. It is understood that not all embodiments of the present invention may have this feature; however, this configuration has the advantages of providing additional support for the pin 66, and may further strengthen the spring arrangement 30. Although the aperture 64 is generally round, it may be other shapes, for example, square, which would accommodate a pin having a square cross section. As seen in FIG. 2, the spring base 62 is disposed within the contact portion 12, and in particular, within the contact portion base 13. Also shown in FIG. 2 is that the spring arms 32, 34, 36, 38 extend through the contact portion 12 and along an outside of a respective pair of contact arms (see also FIG. 1).

Although only one of the contact arms 28 is shown in FIG. 2, it is understood that the pin 66 will be in contact with all of the contact arms 22, 24, 26, 28—see FIG. 1. In particular, the contact arms 22, 24, 26, 28 will be in contact with and provide support at a distal portion 70 of the pin 66. In contrast, the spring base 62, which includes the aperture 64 and neck 68, provides support at a proximal portion 72 of the pin 66. In general, the contact arms 22, 24, 26, 28 and the spring base 62 provide support at substantially opposite ends 70, 72 of the pin 66, even if the support is provided at points located somewhat inwardly from the farthest ends of the pin 66. As described above, the spring heads 50, 52, 54, 56 apply a force to and provide strength for the contact arms 22, 24, 26, 28, and in this way, also help to support the pin 26 at the distal portion 70.

Figure 3:
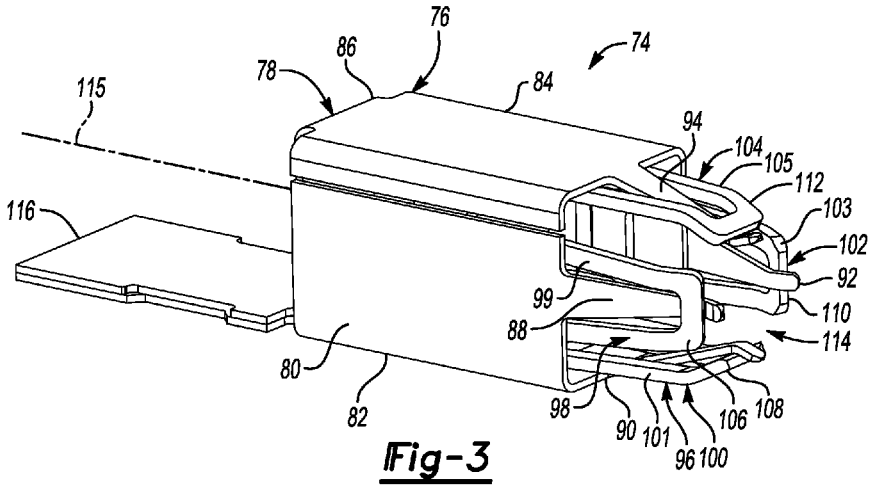
FIG. 3 shows a perspective view of an electrical terminal in accordance with an embodiment of the present invention.

FIG. 3 shows a perspective view of an electrical terminal 74 in accordance with another embodiment of the present invention. The terminal 74 includes a contact portion 76 having a contact portion base 78 and four sides 80, 82, 84, 86 forming a generally rectangular structure. The contact portion 78 further includes four contact arms 88, 90, 92, 94. As described above with regard to the embodiment shown in FIG. 1, the terminal 74 shown in FIG. 5 may also have fewer than or more than four sides, with at least some of them having at least one contact arm extending therefrom. The terminal 74 also includes a spring arrangement 96, which has four spring arms 98, 100, 102, 104. Each of the spring arms 98, 100, 102, 104 includes a pair of elongate members forming respective spring bodies 99, 101, 103, 105 which straddle a respective one of the contact arms 88, 90, 92, 94, and which terminate in a spring head 106, 108, 110, 112.

The spring heads 106, 108, 110, 112 each contact a respective one of the contact arms 88, 90, 92, 94 near a distal end 114 of the contact portion 76 and apply a force in a direction toward an opposite one of the contact arms 88, 90, 92, 94. More generally, each of the spring heads 106, 108, 110, 112 applies a force to a respective one of the contact arms 88, 90, 92, 94 in a direction toward a central axis 115 of the contact portion 76. Like the terminal 10 shown in FIG. 1, the terminal 74 includes a platform 116 configured to connect with a wire or other electrical component, for example, by sonic welding.

Figure 4:
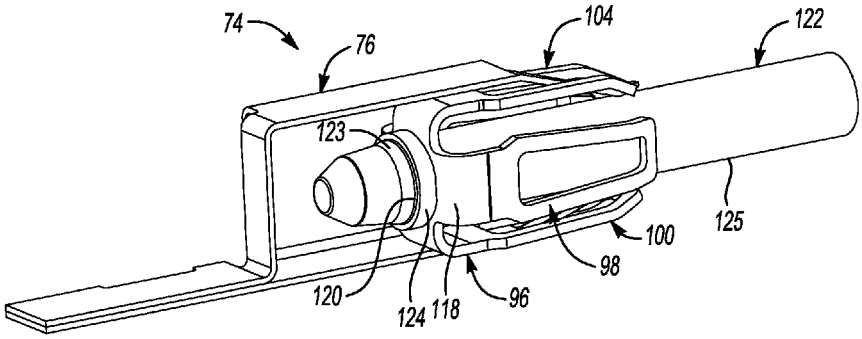
FIG. 4 shows a fragmentary view of the electrical terminal from FIG. 3 with a mating electrical component in the form of a round pin.

FIG. 4 shows a fragmentary view of the electrical terminal 74 shown in FIG. 3. In addition to the spring arms 98, 100, 102 (not visible in FIG. 4), 104, and respective spring heads (not labeled in FIG. 4), the spring arrangement 96 includes a spring base 118, from which each of the spring arms 98, 100, 102, 104 extends outwardly. The spring base 118 and the spring arms 98, 100, 102, 104 are, in this embodiment, made from a single piece of material. The spring base 118 includes a support structure, which in this embodiment includes an aperture 120 disposed therethrough for receiving a mating electrical component, such as a round pin 122. The aperture 120 is sized to receive the pin 122 with a clearance fit, or even a slight interference fit. This configuration helps to support the pin 122 and allows the terminal 74 to mate with much longer pins than might otherwise be possible. Similar to the terminal 10 shown in FIGS. 1 and 2, the spring base 118 of the terminal 74 supports the pin 122 at a proximal portion 123 of the pin 122, while the contact arms 88, 90, 92, 94—see also FIG. 1—support a distal portion 125 of the pin 122.

As described above, an aperture, such as the aperture 120, need not be round, but can be configured to accommodate mating electrical components of different cross-sectional shape, such as a square pin. Similar to the terminal 10 shown in FIGS. 1 and 2, the aperture 120 in the spring base 118 includes a neck 124, which may be formed, for example, through a drawing process. As described above, not all embodiments of the present invention may have a neck, such as the neck 124 surrounding the aperture 120; however, this configuration has the advantages of providing additional support for the pin 122, and may further strengthen the spring arrangement 96.

Figure 5:
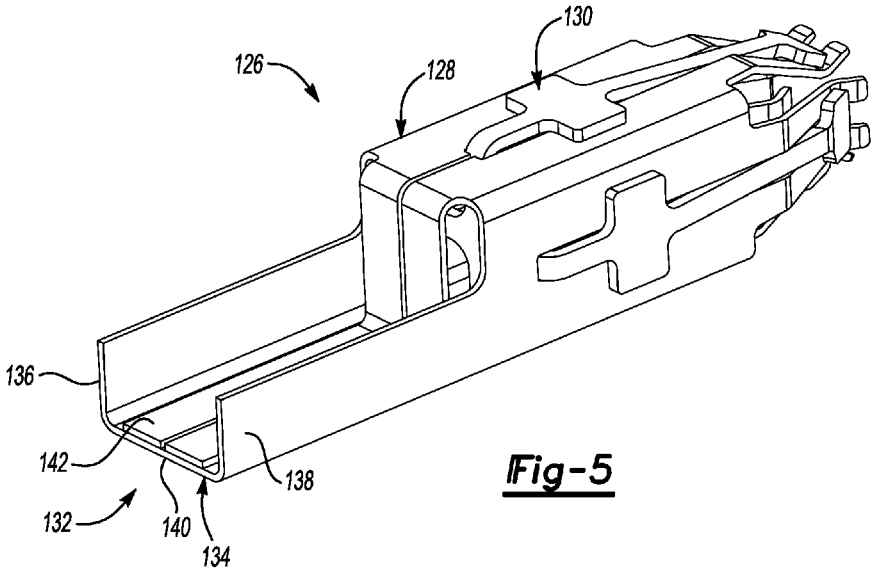
FIG. 5 shows a perspective view of an electrical terminal in accordance with an embodiment of the present invention having a proximal end with sidewalls.

FIG. 5 shows an electrical terminal 126 with a configuration similar to terminal 10 shown in FIG. 1. The terminal 126 includes a contact portion 128 and a spring arrangement 130. A difference is seen, however, in a proximal end 132 of the terminal 126, where a platform 134 is bounded by two sides 136, 138 oriented generally perpendicularly to the platform 134. As shown in FIG. 5, the two sides 136, 138 at the proximal end 132 are extensions of two of the sides that define the contact portion 128. Configuring the proximal end 132 of the terminal 126 with the vertical (as shown in FIG. 5) sides 136, 138, helps to strengthen the platform 134 and may provide additional resistance to bending. This may be particularly important in an application where the terminal 126 is of a very small size.

As described above, a terminal, such as the terminal 126, may be particularly well-suited to high-current, high-temperature applications where the spring arrangement 130 is able to maintain its strength. In these types of applications, it is also desirable to have other portions of the terminal configured to better handle the high-current, high-temperature environment. As shown in FIG. 5, the platform 134 includes two layers of material 140, 142. As described above in conjunction with FIGS. 1 and 3, a platform, such as the platform 134, may provide a point of connection for an electrical component, such as a wire or other conductor. Providing multiple layers of material, such as the layers 140, 142, helps to ensure that there is enough material to handle the high-current, high-temperature applications to which the terminal 126 may be subjected. This may be particularly important, since the platform 134 may be made from the same high conductivity material as the rest of the contact portion 128, for example, a copper or aluminum alloy, and therefore, may be a relatively low strength material; hence, a single layer of this material may not provide the strength and durability desired for these applications.

Figure 6:
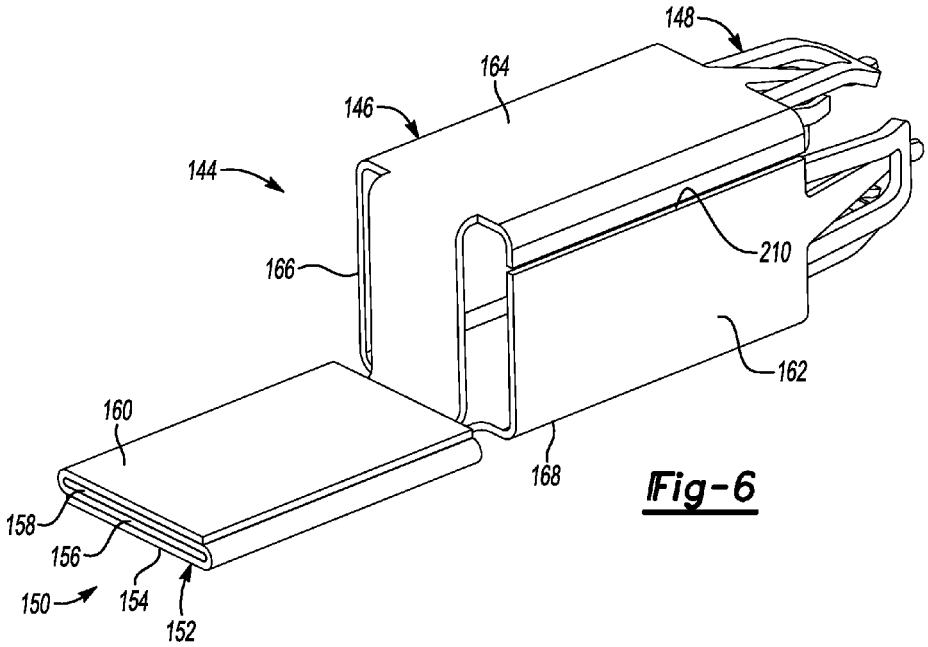
FIG. 6 shows a perspective view of an electrical terminal in accordance with an embodiment of the present invention having a proximal end with multiple layers of material.

FIG. 6 shows an electrical terminal 144, which includes a contact portion 146 and a spring arrangement 148. A proximal end 150 of the terminal 144 is configured with a platform 152 having four layers of material 154, 156, 158, 160, which may provide even more current carrying capability than the two layer platform 134 shown in FIG. 5. These layers of material may be formed, for example, from the four sides 162, 164, 166, 168 of the contact portion 146. Thus, in at least some embodiments, the contact portion 146 can be stamped from a single piece of conductive material, and then folded to define a generally rectangular polyhedron, and then further folded at a proximal end, such as the proximal end 150, to create the layers of material 154, 156, 158, 160. In this way, the layers of material 154, 156, 158, 160 comprise a portion of the four sides 162, 164, 166, 168. Alternatively, a platform, such as the platform 152 can be built-up with additional layers of material as required for a particular application. In this way, at least some embodiments of the present invention can be specifically tuned for particular applications which may have different current carrying requirements and temperature requirements.

Figure 7:
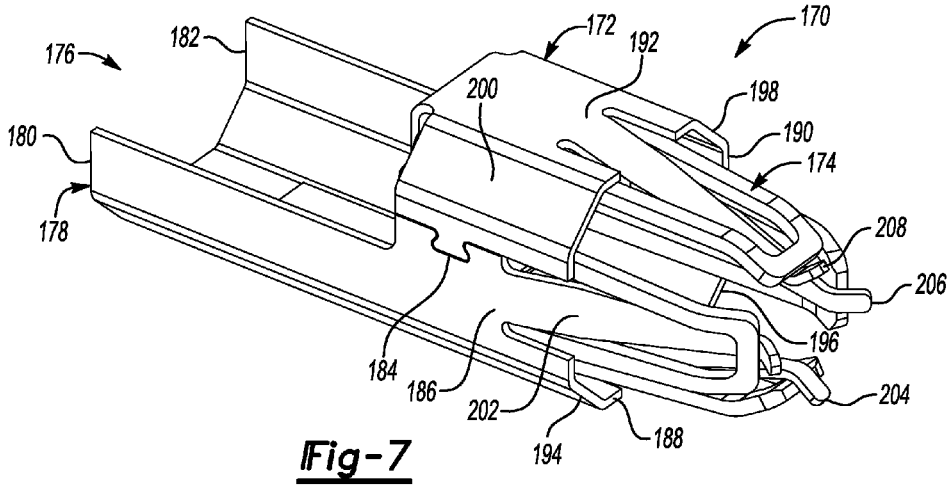
FIG. 7 shows a perspective view of an electrical terminal in accordance with another embodiment of the present invention having a locking contact portion.

FIG. 7 shows an electrical terminal 170, which includes a contact portion 172 and a spring arrangement 174. A proximal end 176 of the terminal 170 includes a platform 178 having two sidewalls 180, 182. The contact portion 172 includes a locking feature 184 that allows the contact portion to lock onto itself. Although the contact portion 172 is octagonal, and thus has eight sides 186, 188, 190, 192, 194, 196, 198, 200, only four of the sides 186, 188, 190, 192 have contact arms 202, 204, 206, 208 extending therefrom, illustrating that in at least some embodiments, not every side of a contact portion need have a contact arm or arms extending from it.

Having a contact portion with a locking feature, such as the contact portion 172 having the locking feature 184, helps to increase the strength of the terminal 170 by eliminating any open channels running a full length of the sides 186, 188, 190, 192, 194, 196, 198, 200 formed when the contact portion is folded into a rectangular or other polyhedron shape, such as the octagonal shape shown in FIG. 7. It also may increase the electrical performance of the terminal 170, by connecting all of sides of the contact portion 172 electrically. Although the locking feature 184 includes a male tab and a mating slot, both generally configured as a trapezoid, locking features in accordance with embodiments of the invention may have other geometric configurations.

Alternatively, electrical terminals in accordance with embodiments of the present invention may have a locking feature that does not include interconnecting geometric shapes. For example, a locking feature may be defined by the addition of a material or by a process for connecting the sides together. For example, the side 162 of the contact portion 146 shown in FIG. 6 includes an open channel 210, which could be laser welded along its length to create a locking feature. Other methods and/or materials for closing the channel 210 to create a locking feature could include, for example, sonic welding, solder, or a conductive adhesive. Locking features of this type may also add strength and improve electrical performance of the terminal.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical terminal comprising:

a contact portion including a contact portion base having a plurality of sides and forming a polyhedron structure, the contact portion further including a plurality of contact arms, at least one of the contact arms extending from a respective one of at least two of the sides, the contact arms being arranged to receive a mating electrical component to contact each of the contact arms at a distal portion of the mating electrical component; and a spring arrangement including a spring base and a plurality of spring arms extending therefrom, each of the spring arms contacting at least one of the contact arms near a distal end of the contact portion for applying a force thereto in a direction toward a central axis of the contact portion, the spring base being disposed toward a proximal end of the contact portion and including an aperture for receiving the mating electrical component therethrough and sized such that a proximal portion of the mating electrical component is supported by the spring base.

2. The electrical terminal of claim 1, wherein the spring base further includes a neck disposed around the aperture such that the neck provides support for the mating electrical component received by the aperture.

3. The electrical terminal of claim 1, wherein the contact portion further includes a platform disposed at a proximal end of the contact portion and configured to receive an electrical component, the platform including a plurality of layers of material.

4. The electrical terminal of claim 3, wherein the platform includes a plurality of sides extending therefrom.

5. The electrical terminal of claim 3, wherein at least some of the layers of material of the platform comprise a portion at least one of the sides of the contact portion.

6. The electrical terminal of claim 5, wherein the platform includes four layers of material comprising a portion of four sides of the contact portion.

7. The electrical terminal of claim 1, wherein the contact portion includes a locking feature connecting the sides of the contact portion together and eliminating any open channels running a full length of the sides.

8. An electrical terminal comprising:

a contact portion including a contact portion base having a plurality of sides and forming a polyhedron structure having a central axis, the contact portion further including a plurality of contact arms, at least one of the contact arms extending from a respective one of at least four of the sides, the contact arms being arranged to receive a mating electrical component to contact each of the contact arms at a distal portion of the mating electrical component; and a spring arrangement including a spring base disposed within the contact portion and toward a proximal end thereof, the spring arrangement further including a plurality of spring arms extending therefrom, each of the spring arms contacting at least one of the contact arms near a distal end of the contact portion for applying a force thereto in a direction toward the central axis of the contact portion, the spring base including a support structure for supporting a proximal portion of the mating electrical component.

9. The electrical terminal of claim 8, wherein the support structure includes an aperture disposed through the spring base for receiving the proximal portion of the mating electrical component therein, the aperture being sized such that the proximal portion of the mating electrical component is supported by the spring base.

10. The electrical terminal of claim 9, wherein the spring base further includes a neck disposed around the aperture such that the neck provides support for the mating electrical component received by the aperture.

11. The electrical terminal of claim 8, wherein the contact portion further includes a platform disposed at a proximal end of the contact portion and configured to receive an electrical component, the platform including a plurality of layers of material.

12. The electrical terminal of claim 11, wherein at least some of the layers of material of the platform comprise a portion at least one of the sides of the contact portion.

13. The electrical terminal of claim 12, wherein the platform includes four layers of material comprising a portion of four sides of the contact portion.

14. The electrical terminal of claim 11, wherein the platform includes a plurality of sides extending therefrom.

15. The electrical terminal of claim 8, wherein the contact portion includes a locking feature connecting the sides of the contact portion together and eliminating any open channels running a full length of the sides.

16. An electrical terminal comprising:

a contact portion including a plurality of contact arms arranged to receive a mating electrical component and support the mating electrical component at a distal portion thereof; and a spring arrangement including a spring base disposed within the contact portion and toward a proximal end thereof, the spring base including a support structure for supporting a proximal portion of the mating electrical component, wherein the support structure includes an aperture disposed through the spring base for receiving the proximal portion of the mating electrical component therein, the aperture being sized such that the proximal portion of the mating electrical component is supported by the spring base, and wherein the spring arrangement further includes a plurality of spring arms extending therefrom, each of the spring arms contacting at least one of the contact arms near a distal end of the contact portion for applying a force thereto in a direction toward a central axis of the contact portion.

17. The electrical terminal of claim 16, wherein the spring base further includes a neck disposed around the aperture such that the neck provides support for the mating electrical component received by the aperture.

18. The electrical terminal of claim 16, wherein the contact portion includes a locking feature connecting sides of the contact portion together and eliminating any open channels running a full length of the sides.

* * * * *